United States Patent [19]

Scharer

[11] Patent Number: 4,645,399

[45] Date of Patent: Feb. 24, 1987

[54] COMBINED PUNCH AND BINDING MACHINE HAVING AN IMPROVED PRESSURE BAR ASSEMBLY

[75] Inventor: Roger M. Scharer, Des Plaines, Ill.

[73] Assignee: General Binding Corporation, Northbrook, Ill.

[21] Appl. No.: 795,080

[22] Filed: Nov. 5, 1985

[51] Int. Cl.[4] ..... B42C 1/00; B42B 4/00; B26D 5/00; B26D 5/08

[52] U.S. Cl. ..... 412/16; 412/40; 83/549; 83/622

[58] Field of Search ..... 412/16, 40, 14; 83/549, 83/147, 618, 66.1, 622, 668

[56] References Cited

U.S. PATENT DOCUMENTS

| | | | |
|---|---|---|---|
| 2,957,380 | 10/1960 | Duncan et al. | 83/549 |
| 3,122,761 | 3/1964 | Bouvier | 412/40 |
| 3,125,887 | 3/1964 | Bouvier et al. | 412/40 |
| 3,227,023 | 1/1966 | Bouvier | 83/622 |
| 3,699,596 | 10/1972 | Lyon | 83/549 |
| 3,793,660 | 2/1974 | Sims | 412/40 |
| 4,008,501 | 2/1977 | Cutter | 83/549 |
| 4,324,013 | 4/1982 | Wu | 412/16 |

*Primary Examiner*—Paul A. Bell
*Assistant Examiner*—Paul M. Heyrana, Sr.
*Attorney, Agent, or Firm*—Hill, Van Santen, Steadman & Simpson

[57] ABSTRACT

There is disclosed herein a combined punch and binding machine having a pressure bar assembly for use in the selected actuation of punch members. The pressure bar includes an elongated back plate having an actuator insert receiving aperture at each end thereof, a row of set pin receiving apertures, and a plurality of forwardly extending stripper plate engaging fingers. The pressure bar assembly also includes an elongated unitary forward member for alignment with and securement to said back plate member. The unitary member includes an actuator receiving recess at each end aligned with said plate receiving apertures. The unitary member also includes a housing defining a row of elongated and forwardly extending set pin receiving slots, each slot aligned with and spaced from the back plate set pin apertures. A spacer shoulder is also provided for spacing the pin receiving slots from the back plate to define a inactive punch receiving space. Leaf spring detents are mounted on the unitary member and overlie each of the slots so as to engage a set pin therein.

9 Claims, 9 Drawing Figures

COMBINED PUNCH AND BINDING MACHINE HAVING AN IMPROVED PRESSURE BAR ASSEMBLY

BACKGROUND OF THE INVENTION

This invention relates to a combined punch and binding machine, and more particularly, to an improved pressure bar assembly for use in punching.

Combined punch and binding machines are known in the art as shown in U.S. Pat. Nos. 3,122,761; 3,125,887; 3,227,023; and 3,793,660. In such machines paper or text material and covers are punched along one edge with apertures and then bound using plastic binding elements having a backbone and curled fingers of the type disclosed in U.S. Pat. No. 1,970,285, so as to form a book, chart or the like. The punching mechanism may be either manually or electrically operated, while the binding operation is normally manual. The punching mechanism includes a laterally extending row of punches mounted on the machine, which are selectively advanced to a punching position and retracted from that position. The pressure bar assembly carries set pins which engage and actuate the punches and stripper fingers which cooperate in retracting the punches. The same pressure bar assembly is used in both the manually- and electrically-operated machines.

In the prior machines, the pressure bar is a fabricated assembly having numerous parts and elements, each of which is stamped or machined and then assembled to form the pressure bar. The separate fabrication and assembling of such parts requires close tolerance machining and stamping and precise alignment in assembly, which can result in a relatively high cost of production.

It is an object of this invention to reduce the close tolerance machining and stamping requirements for the pressure bar.

It is another object of this invention to enhance the ease of assembly and manufacture and reduce the cost of production.

This and other objects of this invention will become apparent from the following description and appended claims.

SUMMARY OF THE INVENTION

There is provided by this invention a combined punch and binding machine which includes an improved pressure bar assembly which has as its principal components a fabricated back plate, a unitary front member for carrying punch engaging set pins, and detent springs for use with the set pins in the the selective operation of punches. This assembly, particularly the unitary front member, substantially reduces the number of component parts, reduces the machining and alignment requirements, and reduces the cost of production. The pressure bar assembly is positioned above the laterally extending row of punches for selectively actuating the punches. A fabricated back plate is positioned rearwardly of the punches and includes stripper fingers for cooperation in retracting the punches from the punching position. The unitary front member is secured to the back plate, extends forwardly thereof and includes a punch set pin and detent carrying housing and a pressure bar actuator receiving recesses. Selected punches are actuated by selecting a corresponding set pin and moving the pressure bar downwardly toward the punches. The assembly is guided in its movement toward and away from said punches by a pair of side plate members.

DESCRIPTION OF THE PREFERRED EMBODIMENT

Figure 1:
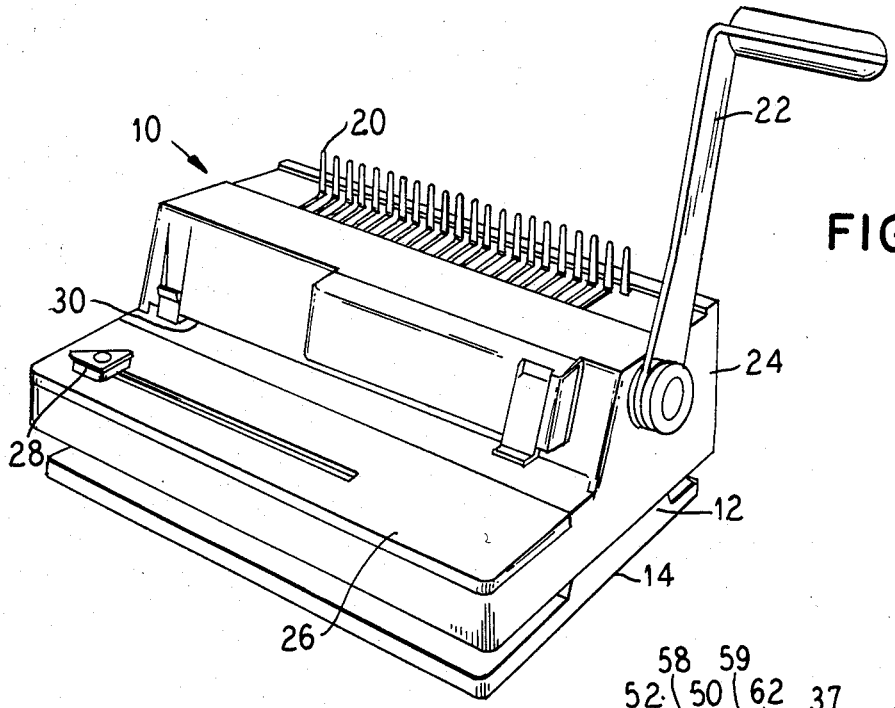
FIG. 1 is a perspective view of a combined punching and binding machine made in accordance with this invention.

Referring now to FIG. 1, a combined punch and binding machine 10, generally, is shown. The machine includes a frame 12, generally, which forms the base 14 and a mechanism supporting portion or platform 16. A punch and binding mechanism 17 is mounted on the supporting portion 16 and includes: a punch mechanism 18; and a binding comb assembly 20 for uncurling a binder element and for impaling punched material on the rings or fingers of an opened binding element. The machine 10 is manually operated, and the actuator handle 22 operates both the punches and the comb. A cover 24 is provided for covering the punching mechanism 18, exposing the comb 20 and defining a support table 26 on which the material to be punched is carried. The support table also includes a guide 28 for laterally positioning the paper or material to be bound with respect to the punches. The material to be punched is inserted into the punch mechanism through an opening 30 in the cover which is aligned with the table 26.

Figure 2:
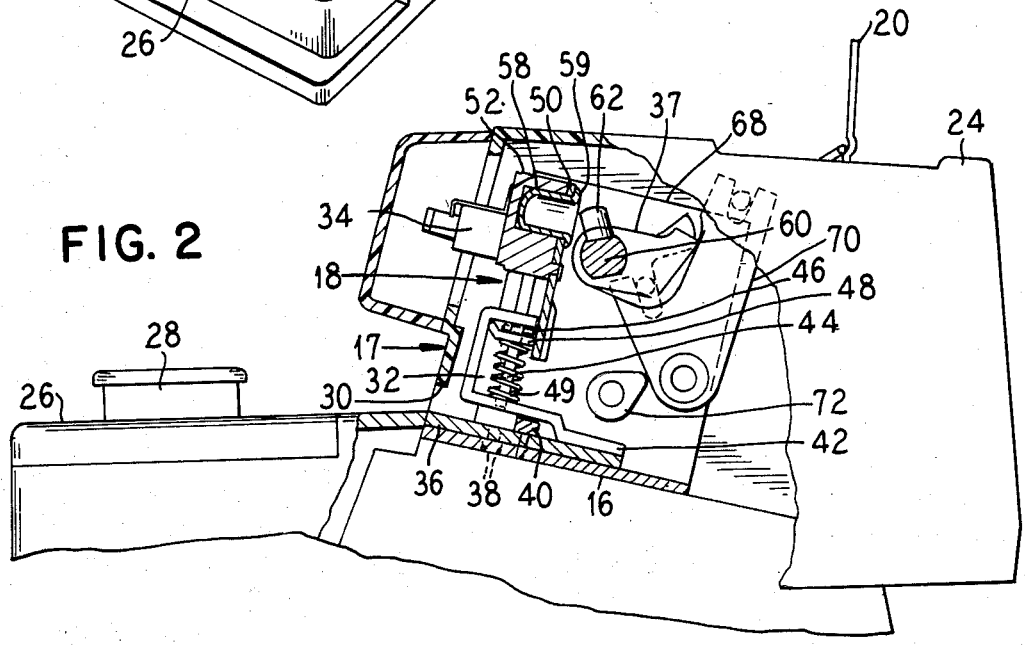
FIG. 2 is a fragmentary vertical sectional view showing the pressure bar and punch mechanisms.
Figure 4:
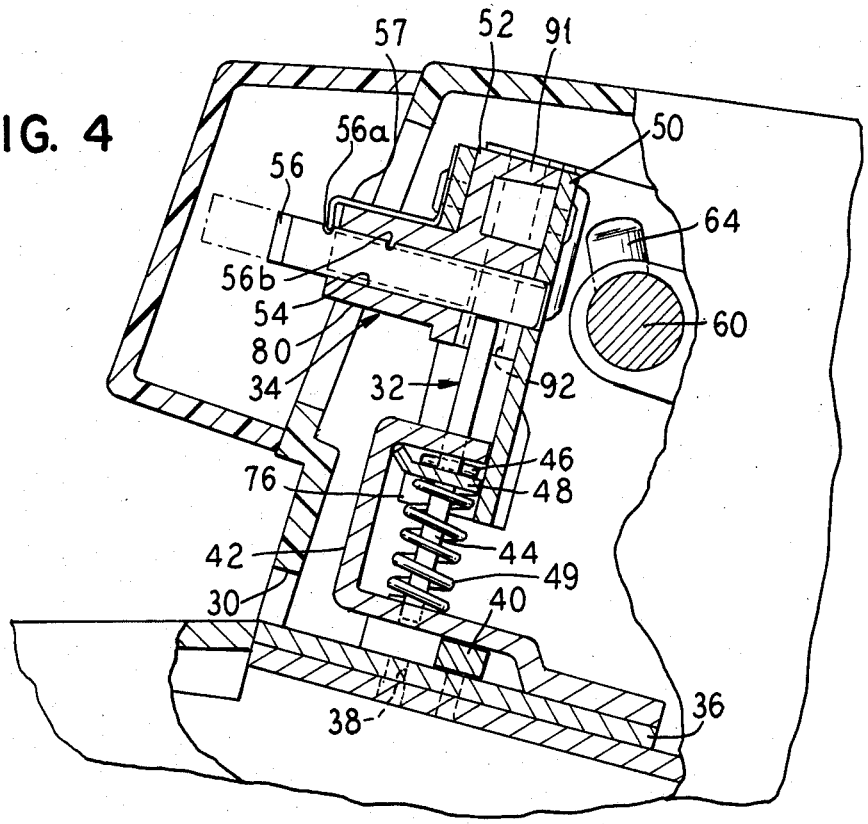
FIG. 4 is an enlarged and fragmentary vertical sectional view, similar to FIG. 2, showing the pressure bar and punch mechanisms.

Referring now to FIGS. 2 and 4, the punch mechanism 18 includes: a punch assembly which includes a series of laterally aligned punches, such as 32; a pressure bar assembly 34; and an actuator assembly 37 for the punches and comb. Each punch, such as 32, is aligned with a die plate 36 in the support portion 16, which plate has punch receiving die openings 38 therein. A back gauge plate 40 is mounted on the supporting portion 16 and is positioned rearwardly of the punch and die for controlling the distance between the edge of punched material and the binding apertures formed therein.

Each punch includes a C-shaped support and guide frame 42, which carries the punch member 44 and guides it during its movement. A cross pin 46 extends through the punch below the top edge of guide 42. A stripper plate 48 is positioned below the cross pin 46, and a biasing spring 49 surrounds the punch and biases the stripper plate 48 against the pin 46. The stripper plate extends along the entire row of punches and engages a pin associated with each punch. In operation, the punch is advanced for punching by the pressure bar assembly and then retracted by the pressure bar assembly 34, lifting the stripper plate 48 against the pins, such as 46, so as to raise the punch 44 and strip it from the punched paper.

The pressure bar assembly 34 includes as its major components a fabricated back plate member 50 and a unitary die cast front member 52, which includes a plurality of set pin receiving slots 54. Set pins, such as 56, are positioned in each slot, and each set pin includes a pair of detent notches **56*a* and 56*b* for selectively positioning the set pin in a retracted, non-punch engaging position as with the detent 56*b*, or in an extended punch engaging position as with detent 56*a*. Leaf springs such as 57 are mounted on the front member 52 for engaging the set pin detent notches. The front member also includes at each end a cup-like actuator insert receiving recess 58 in which the actuator receiving insert 59** is positioned.

Figure 3:
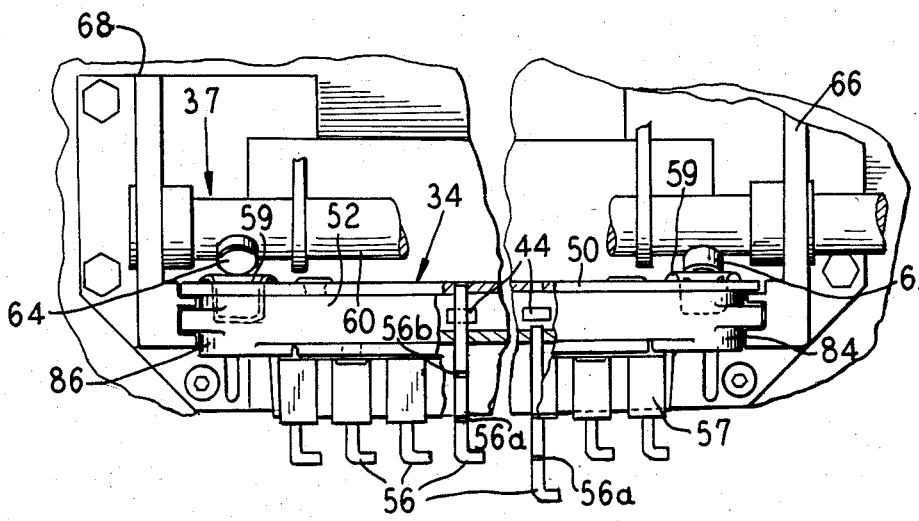
FIG. 3 is a fragmentary plan view showing the pressure bar, pressure bar activator shaft and punch set pins.

The actuator assembly 37 includes an actuator rocker shaft 60 which carries a pair of circumferentially offset actuator pins, one at either end, such as 62 and 64, as shown in FIG. 3. The rocker shaft 60 is connected to the lever 22 so that by moving the lever forwardly the rocker shaft first causes the first actuator pin 62 to engage the right-hand insert on the pressure bar, and as the actuator rocker shaft continues to rotate, the second actuator pin 64 engages the other insert on the pressure bar. The rocker shaft 60 is supported and journalled by a pair of side plates 66 and 68, which also act as a guide for the pressure bar assembly 34. The guides are seen as slots at the front end of the side plates 66 and 68. The unitary member 52 and the side plates 66 and 68 are die cast of zinc, aluminum and copper alloys for high lubricity and excellent bearing qualities so as to eliminate the need for other bearings in the guide and journal areas. The preferred alloys are ZA 8 (8.0–8.8 Al, 0.8–0.13 Cu, 0.010–0.030 Mg, bal. Zn), ZA 12 (10.5–11.5 Al, 0.5–1.25 Cu, 0.015–0.030 Mg, bal. ZN) and ZA 27 (25–28 Al, 2.0–2.5 Cu, 0.010–0.020 Mg, bal. Zn).

The comb 20 is activated as described in U.S. Pat. No. 3,227,023 through the actuator 70, stop cam 72, and other members not shown. The remainder of the comb activating mechanism is not shown herein and a full description is found in the patents mentioned above, such as U.S. Pat. No. 3,227,023 incorporated herein by reference.

Figure 5:
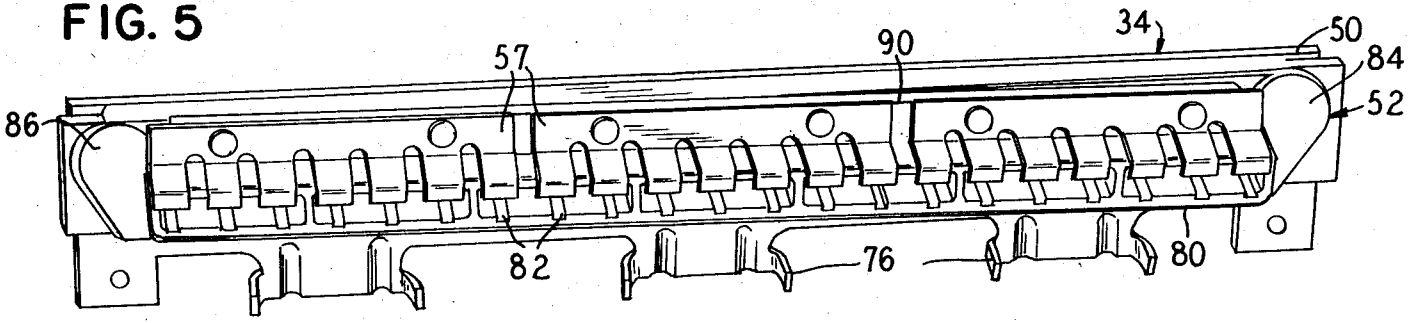
FIG. 5 is a perspective view showing the pressure bar assembly from the front side.
Figure 6:
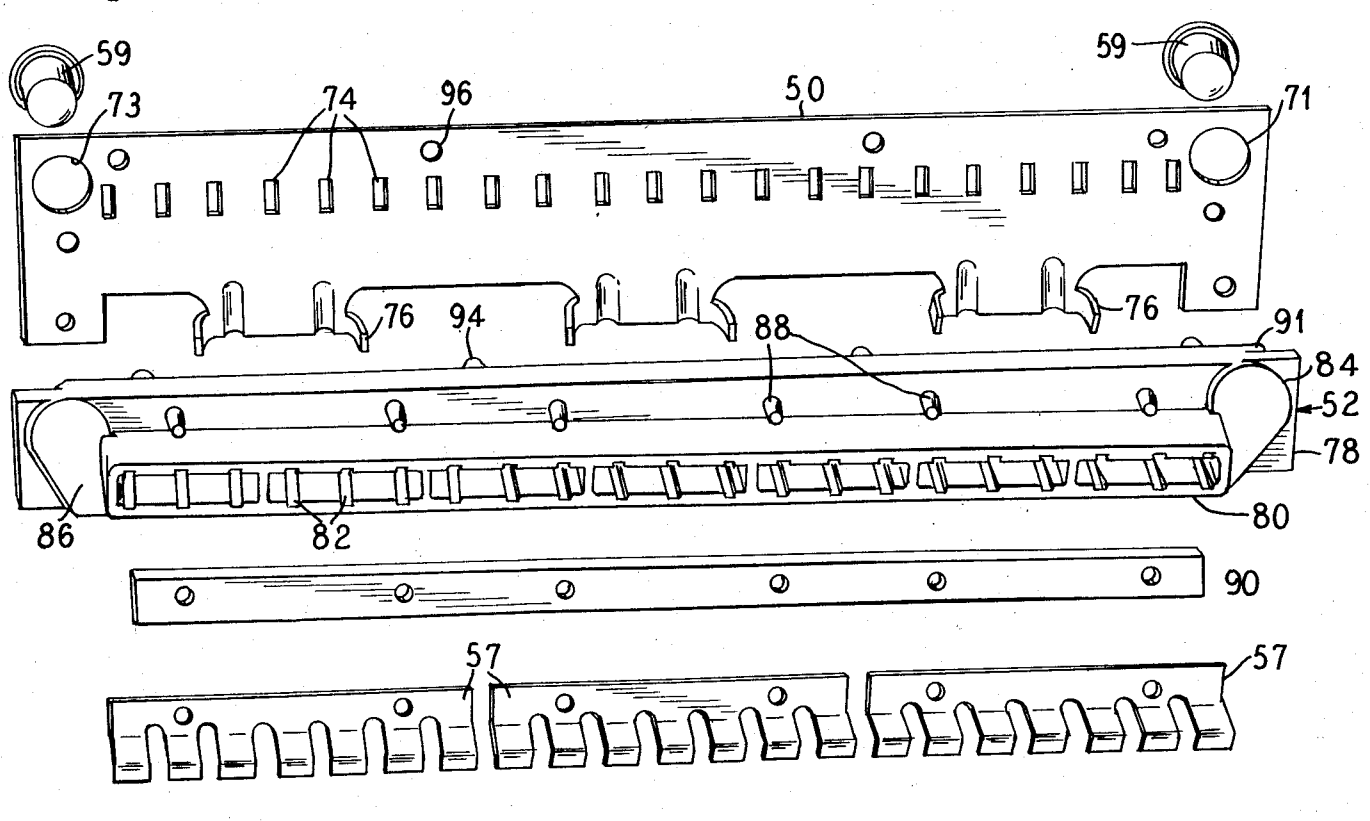
FIG. 6 is an exploded perspective view showing the components of the pressure bar assembly.

The pressure bar assembly 34 as shown in FIGS. 5 and 6 includes the fabricated back plate 50, the unitary front member 52, and the leaf spring members 57. The back plate includes a pair of insert receiving apertures 71 and 73 and a row of set pin receiving apertures such as 74, which row is generally angularly positioned relative to the top edge of the back plate. At the bottom edge of the back plate there are provided forwardly extending stripper fingers such as 76 for engaging and lifting the stripper plate 48 in the punch assembly.

Figure 7:
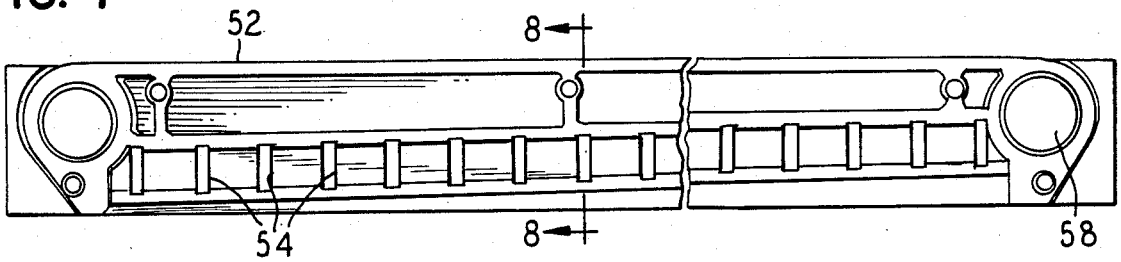
FIG. 7 is an elevational view showing the back side of the unitary member for the pressure bar.
Figure 8:
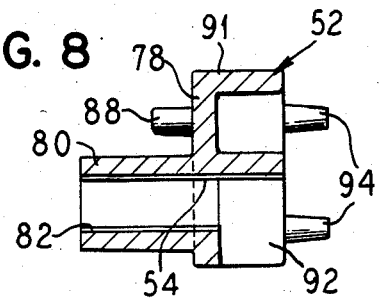
FIG. 8 is a sectional view taken along line 8—8 in FIG. 7.
Figure 9:
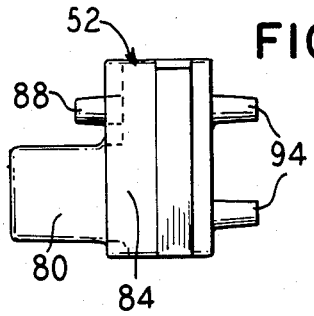
FIG. 9 is an end view of the unitary member.

The unitary front member 52 includes a wall-like portion 78, and a forwardly extending set pin housing 80, which extends through the wall-like portion and defines a plurality of set pin receiving slots therein such as 82. The slots are angularly arranged, extend through the member 52 and are aligned with the back plate apertures such as 74. At each end of the unitary member there is provided a boss-like portion 84 and 86 which is recessed as shown in FIG. 7 for receiving the actuator inserts such as 59. The leaf spring members 57 are mounted to the wall-like portion 78 by pins, such as 88, and a mounting bar 90. Each of the leaves of the springs 57 are aligned with a slot such as 82 so as to cooperate with a set pin detent notch as shown in FIG. 4 at **56*a* and 56*b* and as seen in FIG. 5. As seen in FIG. 3, set pins in the extended position extend through housing 80**, engage the front member, back plate and top of a punch, while in the retracted position the set pins are in the slots in the front member and do not engage the back plate or top of a punch.

The wall-like portion includes a rear spacing shoulder 91 along the upper edge, which cooperates in defining a punch receiving slot 92 between the back of the front member 52 and the back plate 50. Referring to FIGS. 3 and 4, this space between the back plate 50 and front member 52 permits the pressure bar to be lowered so that the selected set pins activate some of the punches, while the stems of inactive punches, such as 44, extend into the space between the back plate and the front plate and remain in the inactive position. The back plate and unitary front member are secured to each other by pins 94, which extend from the unitary member into the securement pin receiving openings 96.

Thus in operation set pins, such as 56, are advanced for actuating selected punches and other set pins are retracted to assure that non-selected punches are not actuated. The actuator handle 22 is pulled forwardly and downwardly so as to rotate the actuator bar, engage the actuator pins in the pressure bar assembly and cause the pressure bar actuator assembly to move downwardly. It will be noted that the right-hand side of the pressure bar assembly moves downwardly before the left-hand side by virtue of the actuator pins being circumferentially offset on the shaft. This permits actuation of the punches, one at a time, rather than simultaneously, for ease of punching. After the apertures are punched, the actuator handle is lifted, thereby lifting the pressure bar assembly, and the stripper fingers engage and lift the stripper plate so as to raise or strip the punches from the punched paper or material.

Although the invention has been described with respect to preferred embodiments, it is not to be so limited as changes and modifications can be made which are within the full intended scope of the invention as defined by the appended claims.

I claim as my invention:

1. A punch and binding machine which includes:

a frame;

a punch and binding mechanism carried on said frame;

said punch mechanism including a row of laterally aligned punch members for forming binding apertures in material to be punched and a pressure bar assembly for selectively actuating said punch members;

said pressure bar assembly including:

an elongated back plate member which defines: an actuator insert receiving aperture at each end thereof; a row of set pin receiving apertures; and a plurality of forwardly extending stripper plate engaging fingers;

an elongated unitary forward member for alignment with and securement to said back plate member, said forward member including: an actuator receiving recess at each end of said member for alignment with said back plate pin receiving apertures; forwardly extending housing means defining a row of elongated punch set pin receiving slots, each slot being aligned with and spaced from the back plate set pin apertures;

and shoulder means for spacing said pin receiving slots from said back plate; and leaf spring means mounted on said unitary member and overlying each of the slots therein so as to retain a set pin in an advanced or retracted position.

2. A machine as in claim 1, wherein there is further provided a plurality of elongated punch set pins, each carried in one of said pin receiving slots and being movable between a retracted non-punch engaging position and an extended position for engaging a punch and engaging a set pin receiving aperture in said back plate.

3. A machine as in claim 2, wherein said each of said set pins includes detent notch means for engagement by a leaf spring to selectively retain said pin in either the retracted or advanced position.

4. A machine as in claim 2, wherein a set pin in the advanced position spans the space between the unitary member and the back plate.

5. A machine as in claim 1, wherein said unitary member is die cast.

6. A pressure bar assembly for use in a combined punch and binding machine for selectively activating selected pins;

said pressure bar being generally U-shaped and including an elongated back plate and an elongated unitary front member;

said back plate having: a top edge with securement means therealong; a pair of actuator receiving insert apertures, one aperture positioned at each end of said plate adjacent said top edge; a plurality of punch set pin receiving apertures extending longitudinally of said plate, spaced from said top edge and being angularly oriented with respect to said top edge; and a plurality of stripper fingers formed along the bottom edge of said plate and extending forwardly;

said unitary member including: shoulder means defining a spacer member along a top edge and having securement means thereon for cooperation with the plate securement means for securing the back plate to the unitary member; a pair of actuator receiving recesses at each end of said member for alignment with said actuator receiving apertures in said plate; a forwardly extending set pin receiving housing section positioned below and forwardly of said spacer shoulder, said housing including a plurality of punch set pin receiving slots extending therethrough, said apertures being angularly oriented with respect to said spacer shoulder and constructed to be aligned with the plate punch set pin receiving apertures;

said back plate being secured to and aligned with said unitary front member so as to define a punch receiving slot therebetween; and cup-like actuator receiving inserts extending through said plate apertures and into said unitary member recess for cooperating in aligning the back plate and unitary front member with respect to each other and for receiving actuator pins therein.

7. A bar as in claim 6, wherein set pin housing in said unitary member includes a forwardly extending, hollow, boss-like member defining a plurality of slots, each slot aligned with a back plate aperture for guiding set pins in their movement toward and away from said apertures.

8. A pressure bar assembly as in claim 6, further including a plurality of set pin biasing means secured to said unitary member and aligned with said set pin slots, for selectively biasing said set pin in a punch engaging position or a punch inactive position.

9. A pressure bar as in claim 7, further including a plurality of set pin biasing leaf spring-like members secured to the unitary member adjacent its upper edge, extending along the boss-like housing member and overlying an end portion of each slot so as to engage a set pin and retain said pin.

* * * * *